US012239226B2

(12) United States Patent
Giovannetti

(10) Patent No.: US 12,239,226 B2
(45) Date of Patent: Mar. 4, 2025

(54) DEVICE FOR SUPPORTING AND FIXING SHELVES OF FURNITURE

(71) Applicant: EFFEGI BREVETTI S.R.L., Segrate (IT)

(72) Inventor: Antonio Giovannetti, Segrate (IT)

(73) Assignee: FERRAMENTA LIVENZA S.R.L., Brugnera (IT)

( * ) Notice: Subject to any disclaimer, the term of this patent is extended or adjusted under 35 U.S.C. 154(b) by 0 days.

(21) Appl. No.: 18/693,784

(22) PCT Filed: Sep. 13, 2022

(86) PCT No.: PCT/EP2022/075456

§ 371 (c)(1),
(2) Date: Mar. 20, 2024

(87) PCT Pub. No.: WO2023/061683

PCT Pub. Date: Apr. 20, 2023

(65) Prior Publication Data

US 2024/0260755 A1 Aug. 8, 2024

(30) Foreign Application Priority Data

Oct. 11, 2021 (IT) ..... 102021000025988

(51) Int. Cl.
*A47B 96/06* (2006.01)

(52) U.S. Cl.
CPC ..... *A47B 96/066* (2013.01)

(58) Field of Classification Search
CPC ..... A47B 96/02; A47B 96/024; A47B 96/06; A47B 96/066; A47B 96/068; A47B 96/07; Y10T 292/096; Y10T 292/0969; Y10T 292/51; E05B 15/04; E05B 17/0037
USPC ..... 248/239, 250; 108/109, 136, 147.16, 108/158.12, 193
See application file for complete search history.

(56) References Cited

U.S. PATENT DOCUMENTS 3,650,588 A * 3/1972 Helland ..... A47B 57/20 211/126.15
3,750,238 A * 8/1973 Tanner ..... A47B 57/20 312/351
5,121,950 A * 6/1992 Davidian ..... E05B 65/104 292/164

(Continued)

FOREIGN PATENT DOCUMENTS

EP 3815576 A1 5/2021
WO 2020212838 A1 10/2020

OTHER PUBLICATIONS

International Search Report for corresponding PCT/EP2022/075456 dated Jan. 4, 2023.

(Continued)

*Primary Examiner* — Muhammad Ijaz
*Assistant Examiner* — Guang H Guan
(74) *Attorney, Agent, or Firm* — Egbert, McDaniel & Swartz, PLLC

(57) ABSTRACT

A device for supporting and fixing a shelf to a side of a furniture item has a casing with an inner cavity, a pin positioned in the inner cavity, and an elastic member urging against the pin such that a tip of the pin protrudes from an edge of the casing in one position. The pin is retractable into the inner cavity of the casing when a force is applied to the pin such that the pin tilts within the inner cavity.

8 Claims, 11 Drawing Sheets

(56) References Cited

U.S. PATENT DOCUMENTS

| | | | | |
|---|---|---|---|---|
| 6,986,488 | B2 * | 1/2006 | Migli | F16B 12/24 248/250 |
| 10,034,542 | B2 * | 7/2018 | Giovannetti | A47B 47/0091 |
| 10,280,960 | B2 * | 5/2019 | Giovannetti | F16B 12/2027 |
| 11,098,740 | B2 * | 8/2021 | Giovannetti | A47C 4/02 |
| 11,268,556 | B2 * | 3/2022 | Giovannetti | F16B 12/2027 |
| 11,877,657 | B2 * | 1/2024 | Cattaneo | A47B 96/066 |
| 2023/0248147 | A1 * | 8/2023 | Giovannetti | F16B 12/32 248/205.1 |
| 2024/0074581 | A1 * | 3/2024 | Giovannetti | A47B 57/20 |
| 2024/0260755 | A1 * | 8/2024 | Giovannetti | A47B 96/066 |

OTHER PUBLICATIONS

Written Opinion of the International Searching Authority for corresponding PCT/EP2022/075456 dated Jan. 4, 2023.
Third Party Observations filed in PCT/EP2022/075456 dated Jun. 23, 2023.
Applicant Comments onThird Party Observations filed in PCT/EP2022/075456 dated Feb. 1, 2024.

* cited by examiner

DEVICE FOR SUPPORTING AND FIXING SHELVES OF FURNITURE

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIALS SUBMITTED ON READ-ONLY OPTICAL DISC, AS A TEXT FILE OR AN XML FILE VIA THE PATENT ELECTRONIC SYSTEM

Not applicable.

STATEMENT REGARDING PRIOR DISCLOSURE BY THE INVENTOR OR A JOINT INVENTOR

Not applicable.

BACKGROUND OF THE INVENTION

1. Field of the Invention

The present invention relates to a device for supporting and fixing furniture shelves, also known as a shelf support, intended primarily, but not necessarily, for bookcases or shelf units in general.

2. Description of Related Art Including Information Disclosed Under 37 CFR 1.97 and 37 CFR 1.98

Referring by way of example to a furniture item of the bookcase type or to a shelf unit, it typically comprises two uprights, or vertical walls, or sides parallel and opposed one to the other, between which are interposed one or more horizontal shelves having the function of defining a resting and support surface for books, magazines, vases and/or other multiple and different objects.

The shelves are arranged and fixed between the vertical walls using means of various types, normally separate from the shelf, such as brackets, screws, pins and the like, which need to be fitted with special tools. This solution is not satisfactory, on the one hand because it makes assembly of the shelf somewhat laborious, and on the other hand because the fixing means remain visible.

Recently, in order to seek to overcome these disadvantages and to avoid the use of tools, technology has provided new solutions for shelf-support devices consisting of an elastic pin that is inserted in an edge of the shelf and having a protruding part that engages in a corresponding seat formed on a side of the furniture item, under the action of a spring. The pin is normally protruding from the device, due to the action of the spring, and when the shelf is assembled, it interferes with the side of the furniture item, retracting into the device to snap out of it when it is opposite the special seat formed in the side of the furniture item. While no tools are required to assemble the shelf, its disassembly requires the use of a special tool on the device, so as to make the pin recede from the seat in the side.

In addition to the disadvantage of having to use tools in order to remove the shelf from the furniture item, it has to be underlined that a second opening in the shelf (usually a hole placed below the shelf at the height of the elastic pin) is required, through it is possible to access the device in order to cause the pin to retract against the action of the spring.

EP 3815576 A1 describes a support device for shelves of furniture items comprising a pin designed to be arranged inside a shelf and movable axially against the action of elastic means between a position recessed in the shelf and a position protruding therefrom to engage in a hole provided in a side of the furniture item, wherein said pin has a tip terminating in an inclined plane.

The object of the present invention is to overcome the abovementioned disadvantages. More particularly, an object of the present invention is to provide a device for supporting and fixing furniture shelves which does not need tools for mounting and/or removing the shelf from the furniture item.

A further object of the invention is to provide such a device that does not need different openings on the shelf other than the one for mounting the device itself, such that it is made substantially completely hidden from view so as to optimise the aesthetic merit of the furniture item.

A further object of the invention is to provide such a device that allows easy and rapid assembly and disassembly of the shelf.

Yet another object of the invention is to provide such a device that is simple and inexpensive to manufacture.

BRIEF SUMMARY OF THE INVENTION

According to the invention, a device is provided for supporting and fixing shelves to the sides of furniture items, such as bookcases, shelf units and the like, configured to be inserted in the edge of a shelf to engage with a side of the furniture item, said device comprising a casing of substantially cylindrical shape with an internal cavity having a front opening, inside of which housing is mounted a pin which is stressed by elastic means, with a tip of the pin normally protruding from the edge of the casing under the action of said elastic means, wherein said inner cavity of the casing has at least partially an elongated cross sectional shape like said front opening, with opposing side walls, such as to house the pin loosely in a direction parallel to said opposing side walls which have longitudinal recesses designed to accommodate corresponding raised parts provided on the pin, in such a way that the pin is restrained locked in the casing with the tip protruding therefrom, propelled by said elastic means, and in such a way that a force opposing the action of said elastic means causes the pin to retract in the casing with a tilting action in a direction parallel to said opposing side walls of said cavity with elongated cross sectional shape.

Advantageous embodiments of the invention are disclosed by the dependent claims.

BRIEF DESCRIPTION OF THE SEVERAL VIEWS OF THE DRAWINGS

The constructional and functional features of the device for supporting and fixing shelves of the present invention will be made clearer by the detailed description that follows in which reference is made to the accompanying drawings that show a preferred and non-limiting embodiment thereof, and in which.

DETAILED DESCRIPTION OF THE INVENTION

Figure 1:
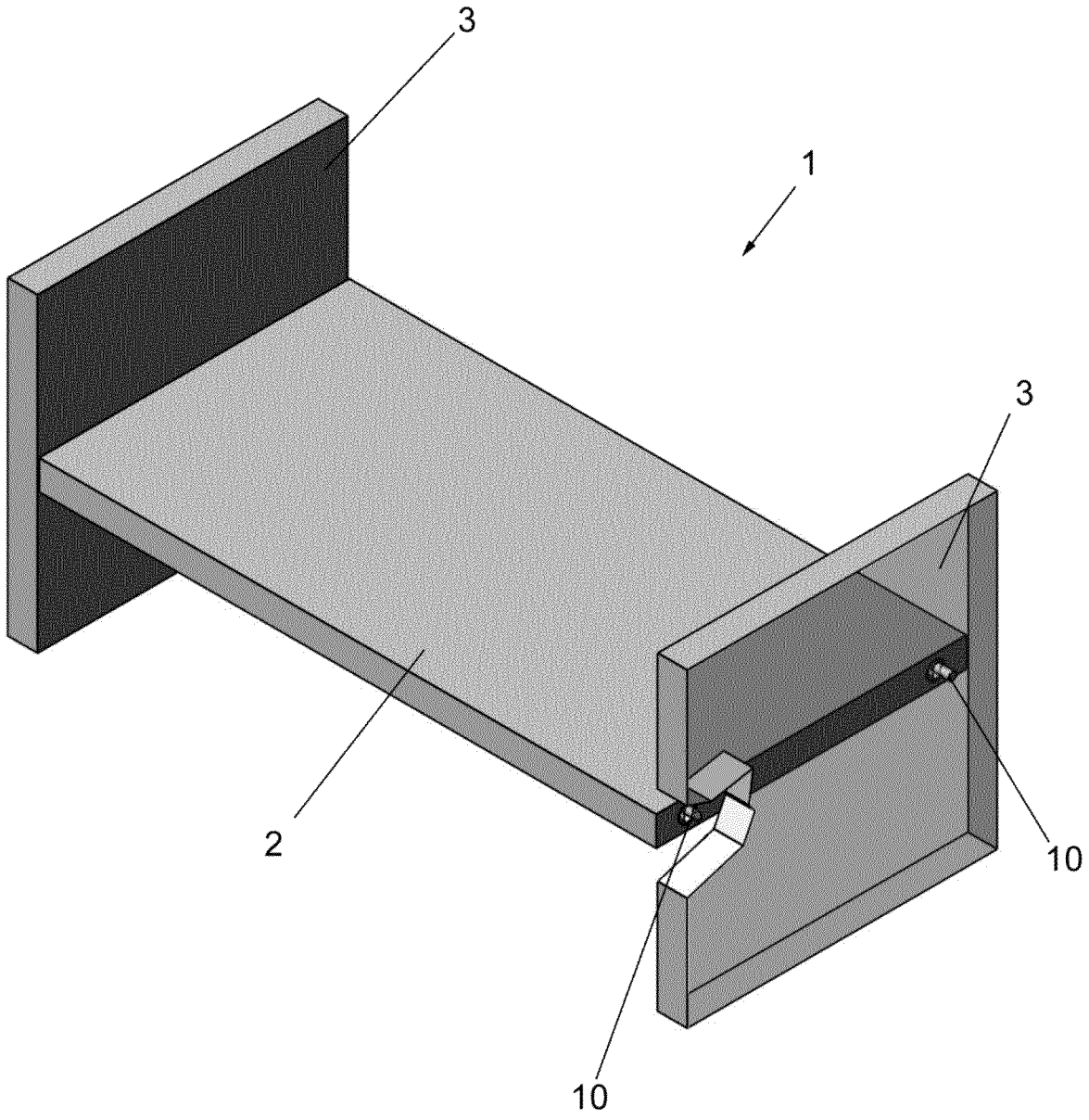
FIG. 1 is a schematic axonometric view showing a shelf arranged between two sides of a furniture item, with cut-away and transparency parts, to show the positioning of two supporting and fixing devices according to the present invention.

FIG. 1 schematically shows a portion of furniture item 1, comprising a shelf 2, mounted between two vertical side walls or sides 3 by means of four supporting and fixing devices 10 according to the invention, two of which are made visible in the drawing.

Figure 2:
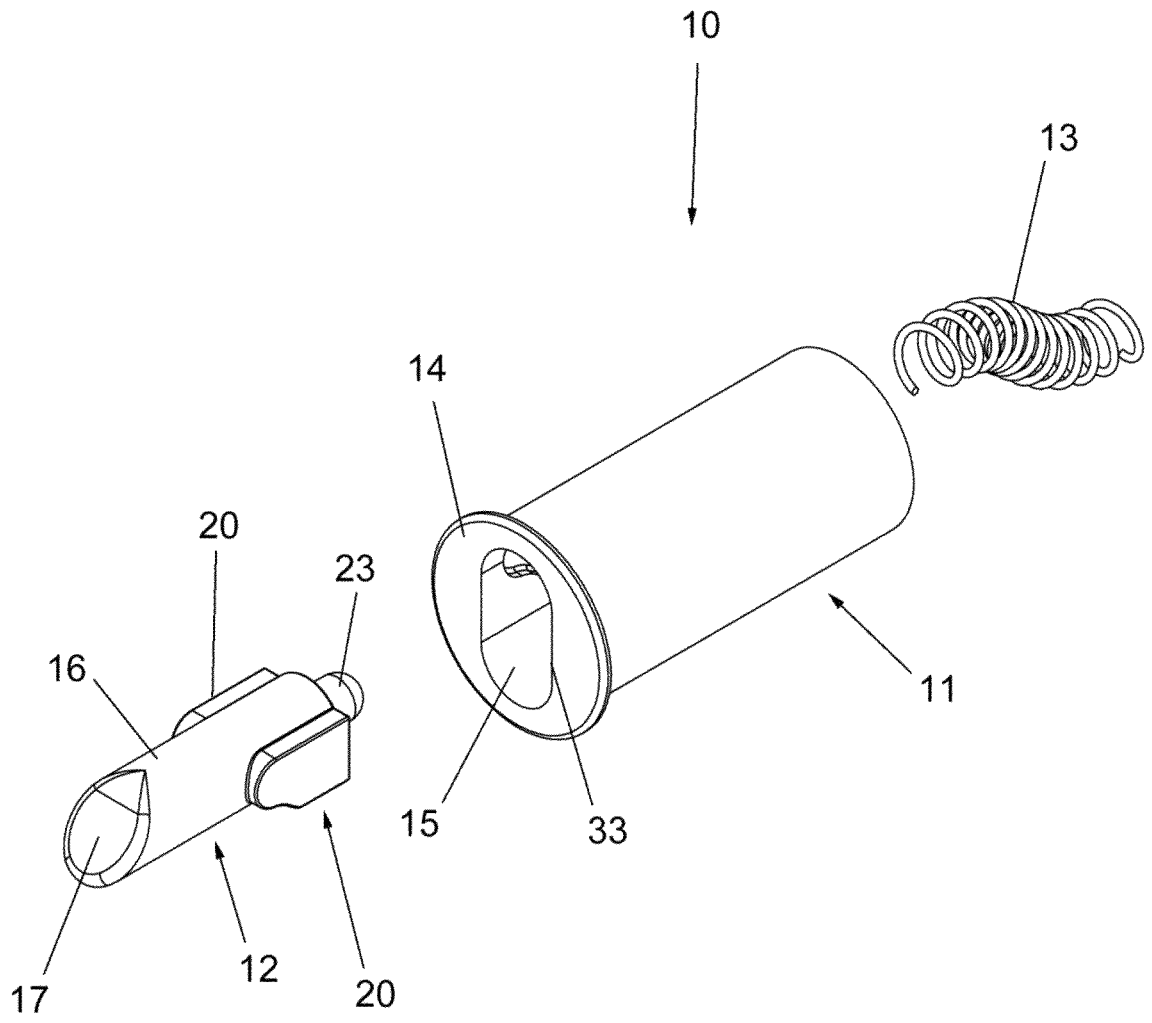
FIG. 2 is a blown-up axonometric view of a device according to the invention.

Referring to FIG. 2, the device 10 comprises an outer body or casing 11 with a substantially hollow cylindrical shape, inside whereof is mounted a pin 12 that is stressed by a compression spring 13. A helicoidal spring is shown in the drawings, but any elastic element is contemplated by the invention.

The device 10 is housed in a hole 4 formed in the thickness of the shelf 2 with the front surface of the casing 11 practically flush with the edge of the shelf, and the pin 12 protruding therefrom to be inserted in a hole 5 formed in the side 3 of the furniture item, as shown, for example, in FIG. 6 and as will be described in greater detail here below.

Advantageously, the casing 11 has an annular expansion or collar 14 at the front that abuts against the edge of the shelf 2 to determine an end of stroke condition during the phase of inserting the device in the hole 4.

In shelf 2, apart from hole 4, no other machining processes are provided, either on the upper or on the lower one, which improves the overall aesthetics.

The casing 11 is of the tubular type, open at both ends, and has an inner cavity 15 suitably shaped to accommodate the pin 12 with the possibility of sliding and tilting, as will be described in greater detail here below.

The pin 12 is substantially cylindrical in shape and has a front section or tip 16 that can protrude at least partially in front of the casing 11 to be inserted in the hole 5 formed in the side of the furniture item, and terminating with a bevelled, tapered end 17. Behind the tip 16, at the two sides of the pin 12, respective raised parts 20 of a substantially rectangular shape are provided, which develop in the axial direction of the pin 12 and terminate at the front with a rounded ogival end 21, joined to the base of the rectangular raised part with a concave profile section 22.

Figure 4A:
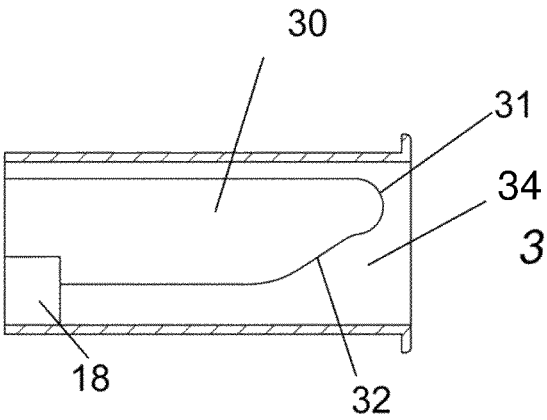
FIG. 4*a* is a section along plane A-A of FIG. 4.
Figure 4:
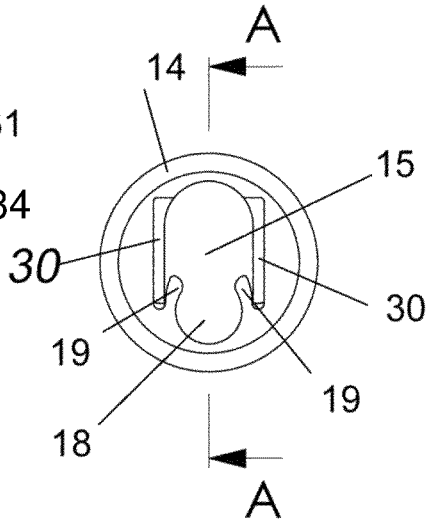
FIG. 4 is an end view of the casing taken from the left side of FIG. 3.
Figure 5:
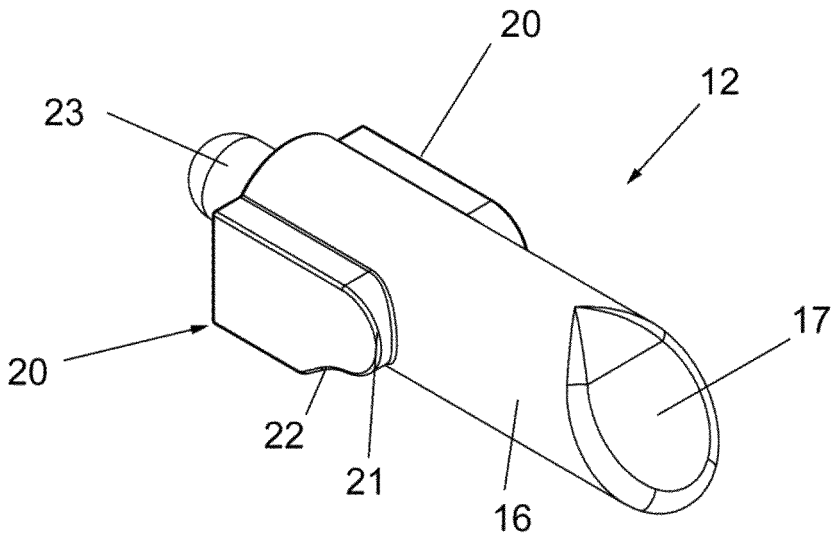
FIGS. 5 and 5*a* are, respectively, an axonometric view and a side view of the pin housed in the casing of FIGS. 3 and 4.
Figure 5A:
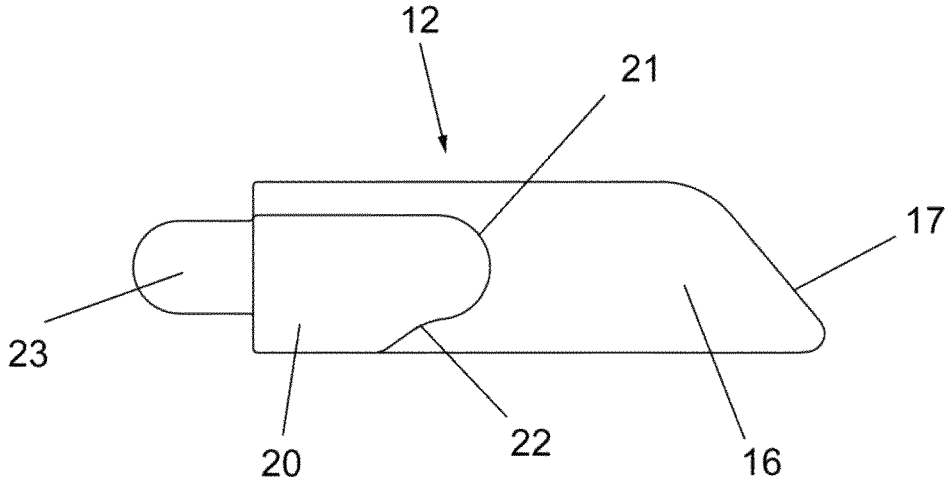

Correspondingly, the inner cavity 15 of the casing 11 has on its opposing side walls 34 (one of which is shown in FIG. 4*a*) a pair of side recesses 30, designed to accommodate with longitudinal sliding the raised parts 20 of the pin 12. The width or height of the recesses 30 tends to decrease in the front part with an upward convex profile section 32 terminating with a rounded end with substantially semi-circular profile 31, designed to accommodate the rounded ogival end 21 of the raised parts 20 of pin 12, while the concave section 22 of the raised parts matches perfectly with the convex section 32 of the recesses.

Thanks to coupling parts, the pin 12 remains restrained in the casing 11 even when the tip 16 is fully withdrawn, under the action of the elastic means 13, which act between a rear seat 18 formed in the casing 11 and the rear part of the pin 12.

More particularly, to the rear of the pin 12 a cylindrical protrusion 23, of a smaller diameter than the pin, is provided in such a way that it is possible to insert it in the helicoidal spring 13 and, on the other side, the seat 18 has a circular profile, of a smaller diameter than that of the spring, which develops for an arc of approximately 270° terminating with two opposing fins 19 with which the terminal coils of the spring 13 go to engage, which thus remains embedded in the seat 18.

Naturally, that which is shown in the drawings is only an example of a way of fixing the end of the spring, as many other solutions are possible. For example, the housing 18 could be of such a diameter as to accommodate the spring, and be closed at the rear, completely or partially, by a wall flush with the rear end of the casing 11.

Figure 3:
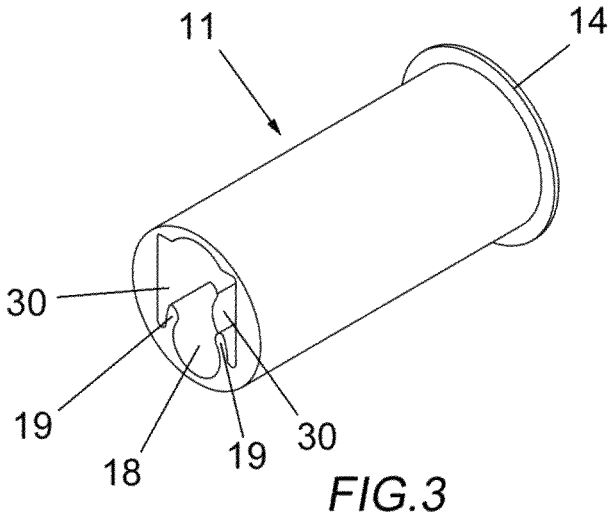
FIGS. 3 and 3*a* are axonometric views taken from opposite angles, of the casing of the device according to the invention.
Figure 3A:
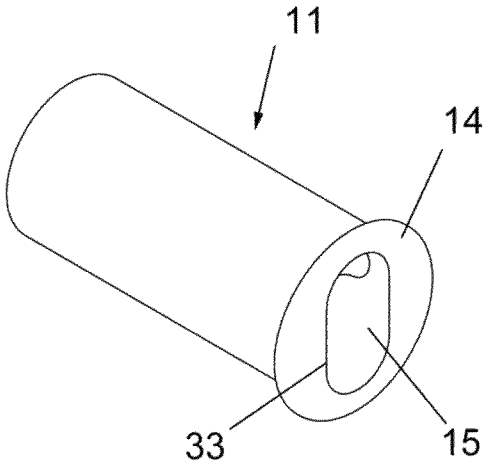

As can be seen in particular in FIGS. 2 and 3*a*, the front opening 33 of the casing 11 has an elongated, substantially elliptical shape with a vertical axis, with parallel opposing sides, in order to allow the tilting of the pin 12, which has a diameter smaller than the vertical dimension in which said front opening 33 is elongated and is normally arranged in its upper part. Consequently, the cavity 15, which substantially reproduces the shape of the front opening 33, has substantially flat opposing side walls 34, in which the aforementioned recesses 30 are formed, and houses the pin 12 loosely in a vertical direction, i.e. in a direction parallel to said opposing side walls 34.

Figure 6:
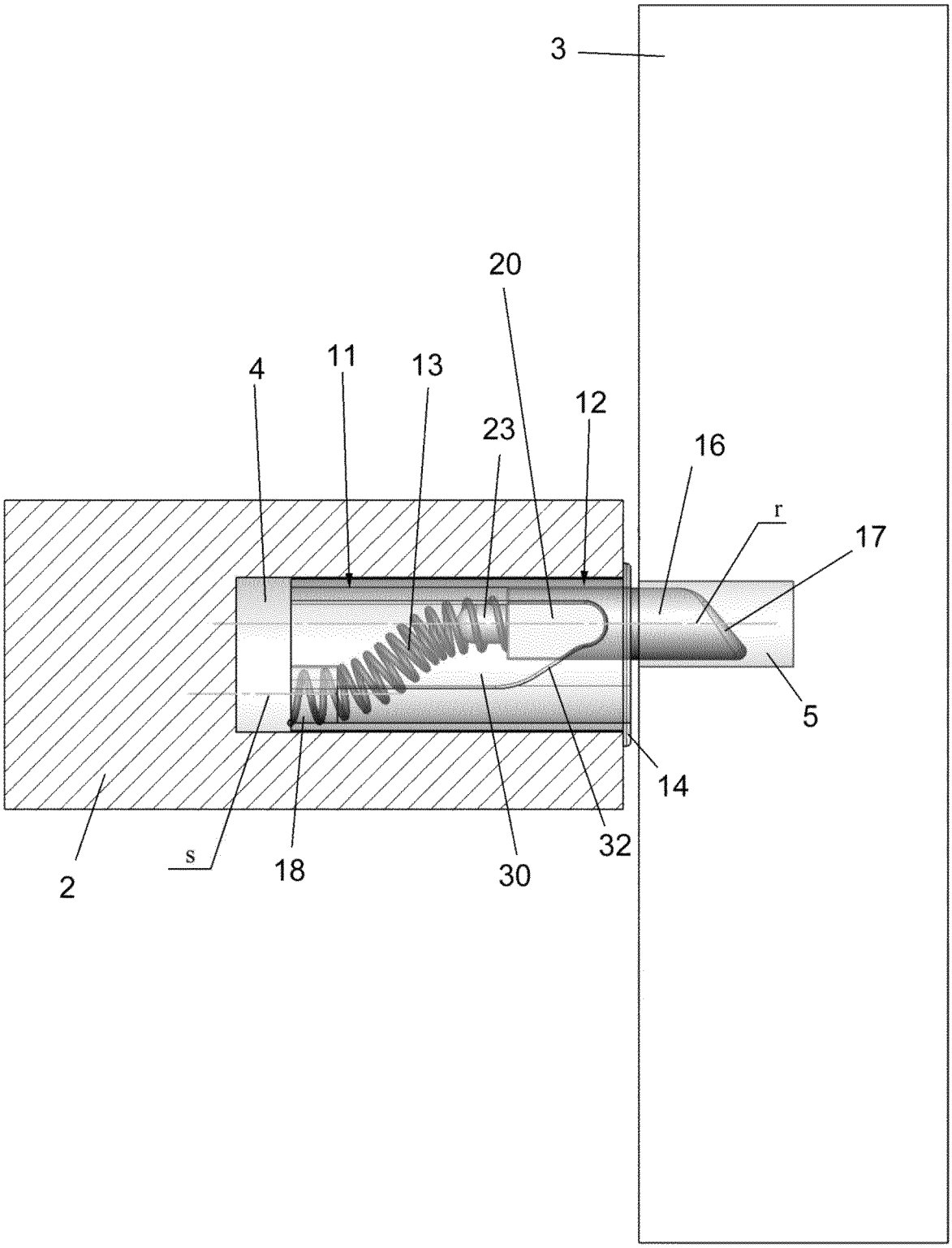
FIG. 6 is a schematic sectional view of a shelf provided with a device according to the invention with the pin in a position of engagement with a side of a furniture item.

Referring to FIG. 6, the device 10 can be observed mounted and in its function of supporting the shelf 2.

Having indicated with "r" the main axis of the pin 12, coaxial with its tip 16, and with "s" the axis of the seat 18, apt to accommodate the elastic element 13, it can be observed that they are not coincident one with the other, but parallel and offset. This is an advantageous condition for the positioning of the elastic element 13 in that it allows three substantial advantages to be had.

The first advantage is to simplify the equipment for moulding of the casing 11 in that in order to make both the recesses 30 and the seat 18 there is no need for movements inside the mould which would complicate the making thereof and limit the number of possible impressions.

The second advantage is one of simplification during assembly with the insertion of the pin 12 along the "r" axis from the rear of the casing 11 without additional movements apt to override the seat 18 of the spring.

The third advantage is functional in that in the unhooking/hooking phases of the shelf 2, when the pin 12 retracts into the casing 11, the pin-spring combination has reduced overall dimensions along the "r" axis in that this axis is not engaged by the spring 13 thus allowing a less bulky product in length to be made with all the advantages that this entails, since the installer does not have to drill deep holes in the shelf 2.

Aside from the advantages listed above, the device 10 has the same functioning even if the axes "r" and "s" are coincident.

Figure 7:
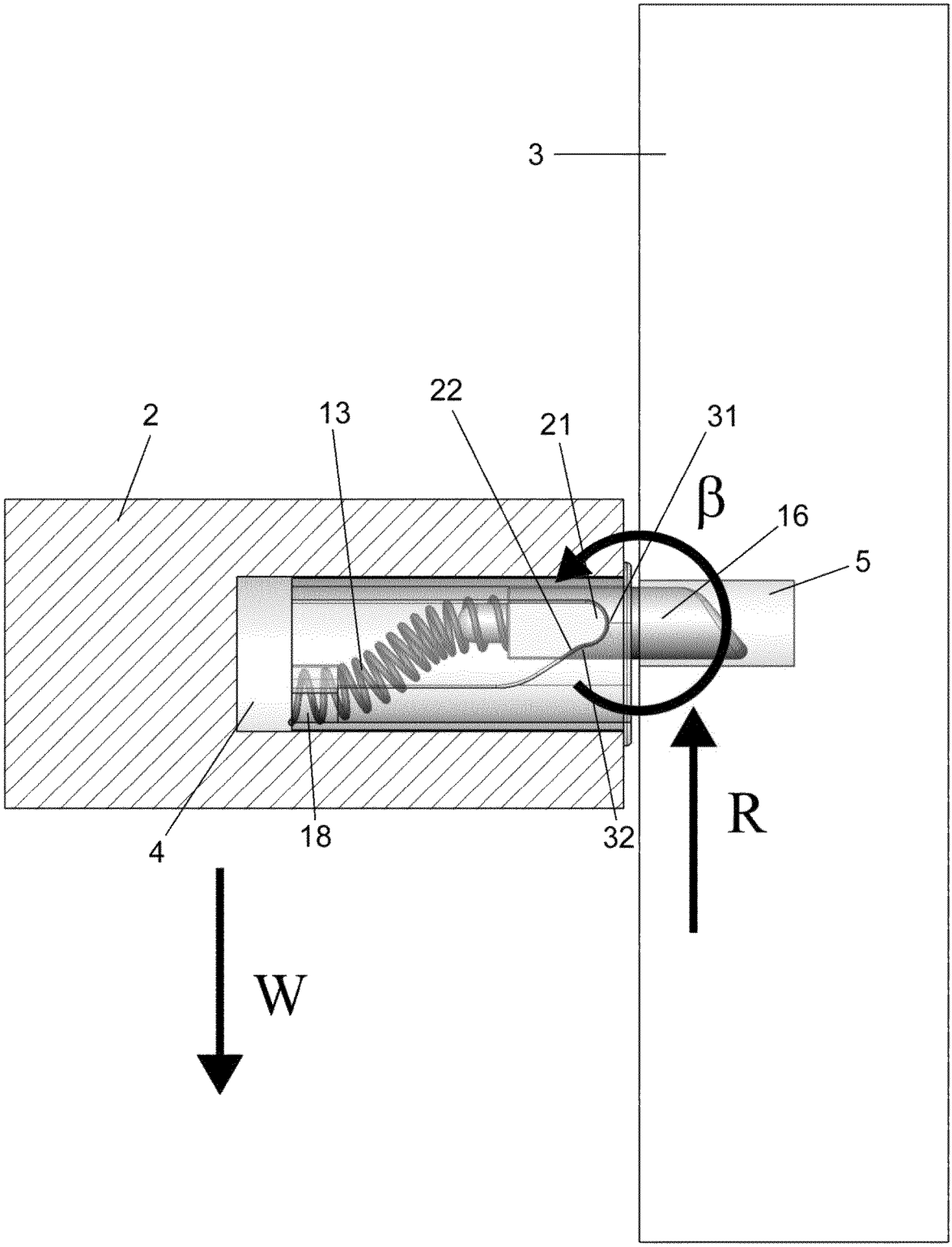
FIG. 7 is a view like that of FIG. 6, with the addition of arrows indicating the forces that act on the device.

Referring to FIG. 7, it is illustrated how the device 10 supports the shelf 2.

The shelf 2 exerts a load, both through its own weight and what it supports, which load is distributed over the various shelf supports 10. Having indicated, therefore, by "W" the share of the load that the shelf transmits to the individual shelf support, the pin 12 will receive a reaction "R" undergoing a rotation "B" with respect to the casing 11, which is contrasted by the simultaneous action between the cylindrical portion of the pin 12 with the inner cavity 15 of the casing 11 and by the reciprocal action of the rounded ends 21, 31, of the raised parts 20 and of the recesses 30 respectively, effectively preventing the movement of the pin 12 with respect to the casing 11 and consequently performing the function of supporting the shelf 2.

Figure 8:
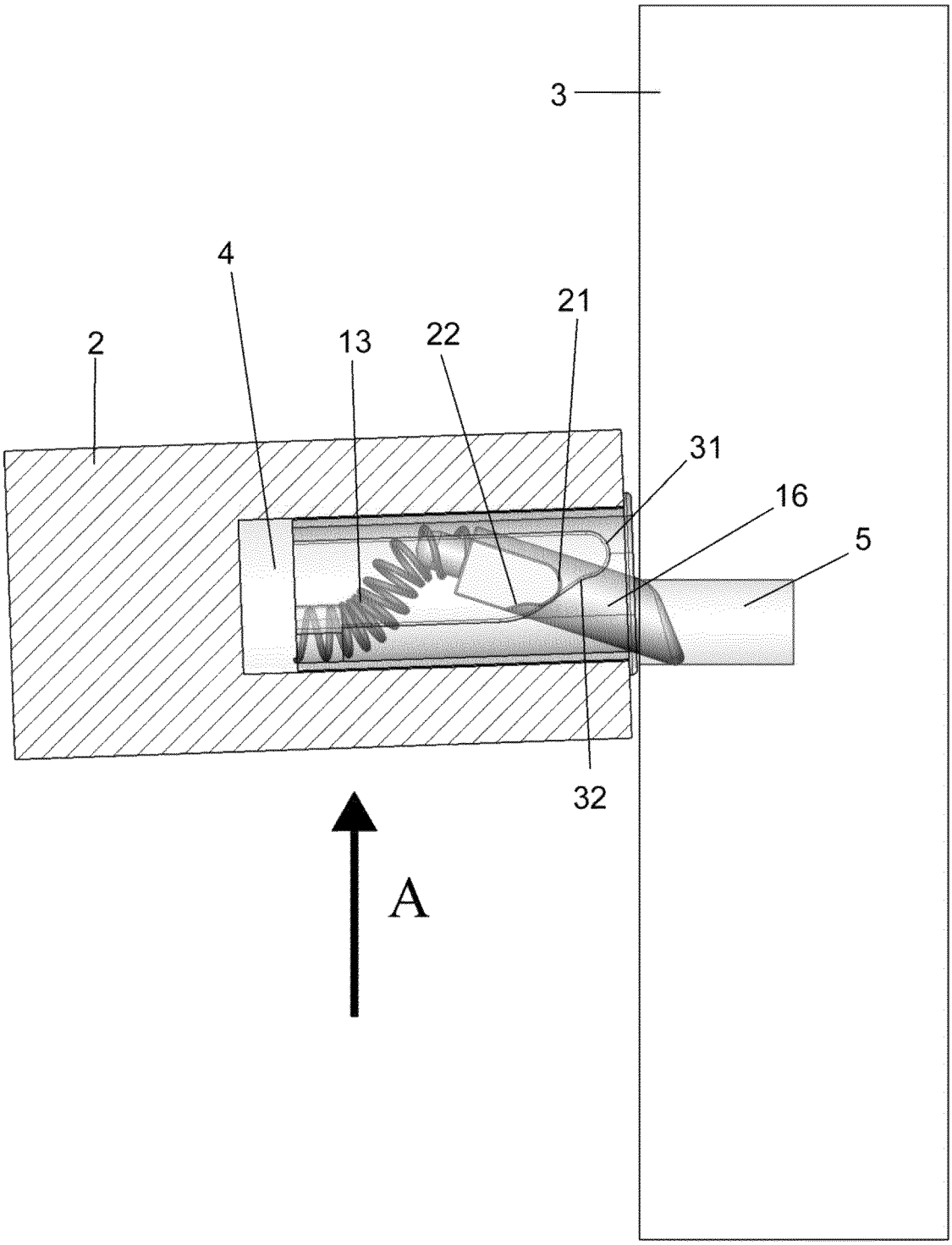
FIGS. 8 and 9 are views like that of FIG. 6, showing successive phases during disassembly of the shelf.

The behaviour just described instead does not occur in the opposite condition, i.e. when shelf 2 is lifted, and therefore an action contrary to the direction of "W" is exerted, as illustrated in FIG. 8.

The shelf 2 under the action of the force "A" opposite in direction to "W" finds the reaction of the rounded end 21 of the raised parts 20 of the pin 12 on the convex profile section 32 of the recesses 30 of the casing 11. Initially, the pin 12 will be axial to the hole 5 formed in the side 3 of the furniture item, but when the guide offered by the hole 5 is lacking, it will be arranged as illustrated, receding, upon the persistence of the action of the force "A", inside the casing 11 with a sliding of the rounded ends 21 on the convex profiles 32 and consequent tilting of the pin 12, which is permitted by the vertically elongated shape of the front opening 33, and in general of the inner cavity 15 of the casing 11.

Figure 9:
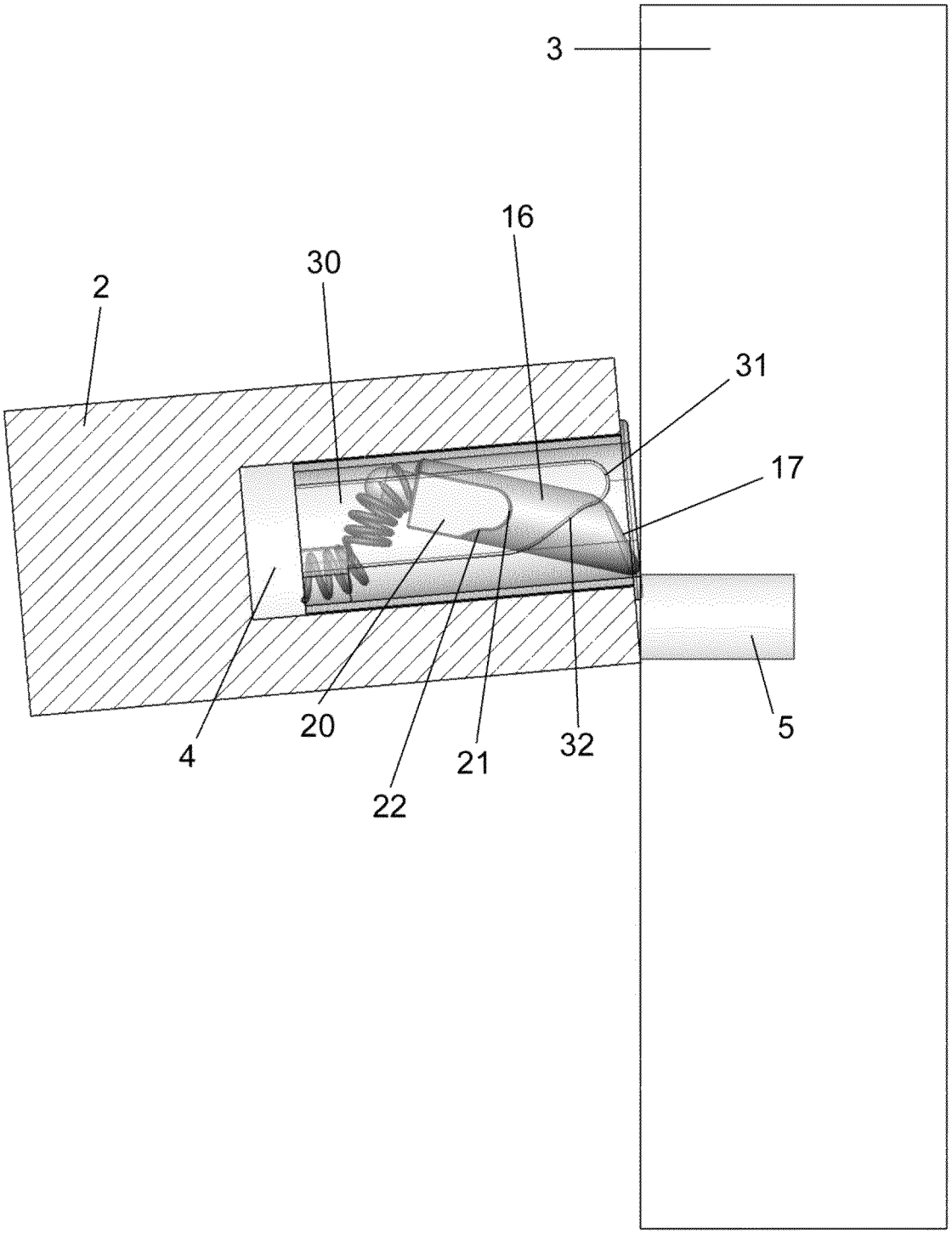

At the continuation of the action of the force "A", with reference to FIG. 9, the tip 16 will be in direct contact, with its end 17, with the wall of the side 3 of the furniture item. Therefore, in the final phases the recess will terminate with the direct contact of the end 17 on the wall itself.

The inverse phase, i.e. of insertion of the shelf 2 in the furniture item 1, sees the pin 12 banally being completely retracted inside the casing 11 by interference with the side 3, until arriving at the hole 5 present in the side 3 in which the pin 12 will have the possibility of being inserted, pushed by the elastic element 13.

It should be noted that the assembly of the shelf 2 can take place irrespectively either by sliding the tip 16 of the pin 12 against the side 3 of the furniture item with an action from the top downwards, which is exactly the reverse of the sequence shown in FIGS. 7 to 9, or conversely, with an action from the bottom upwards, which is, moreover, facilitated by the bevelled end 17 of the tip 16.

The device described hitherto fully fulfils the functions listed in the introduction to this description. To complete it, in order to fulfil certain needs that may arise in use, it may be required that the shelf does not disengage from its seat, for example as a result of incorrect manoeuvres or in the case of movement of the furniture item, even should it be overturned.

Figure 10:
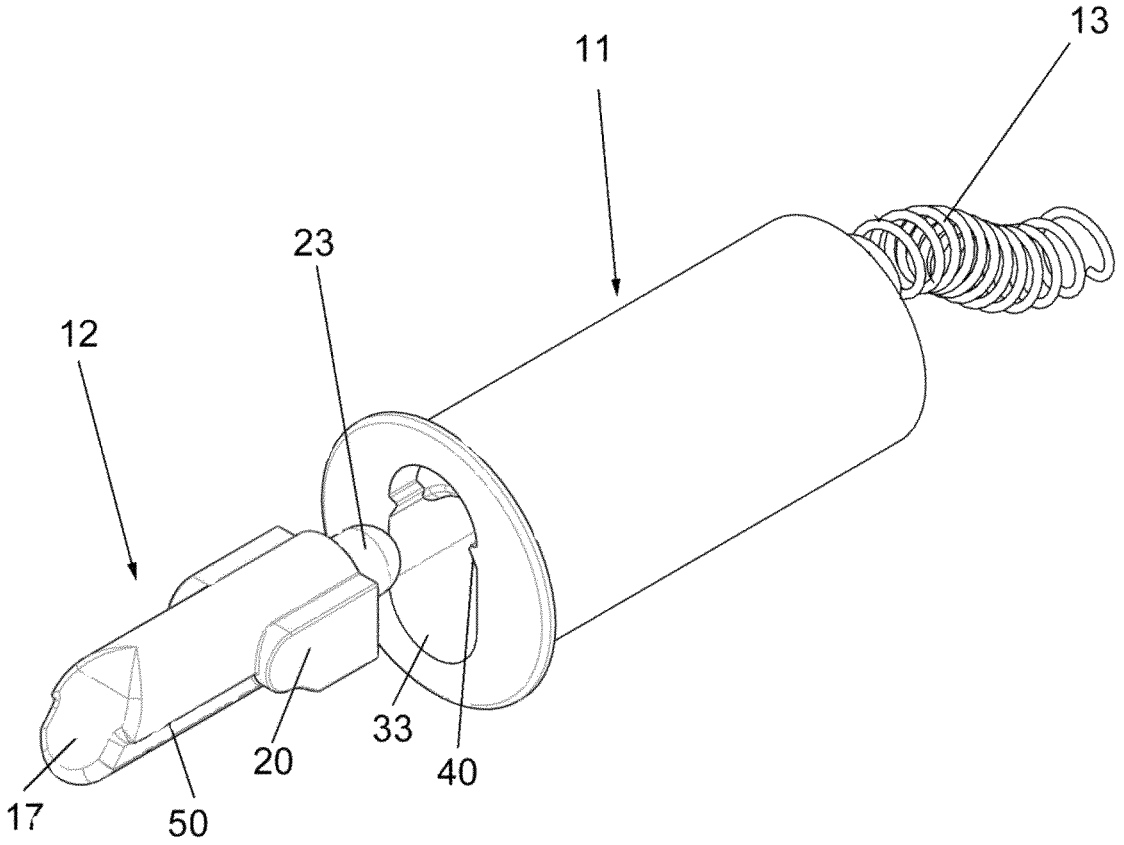
FIG. 10 is a blown-up axonometric view of an alternative embodiment of the device according to the invention.
Figure 11:
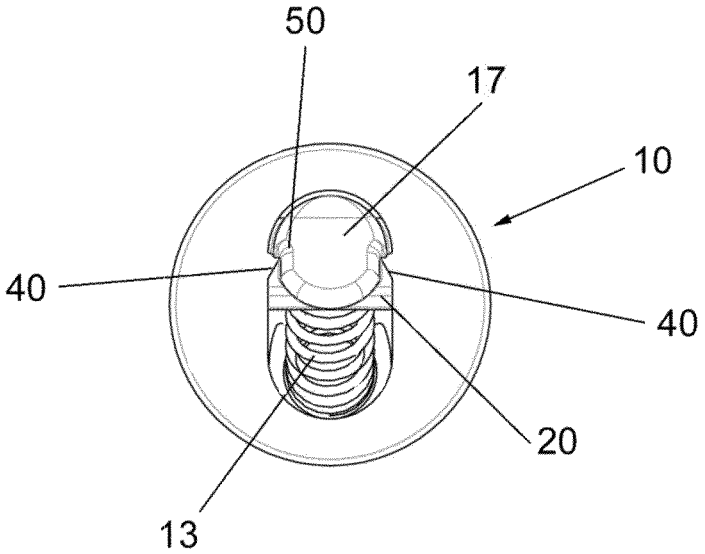
FIG. 11 is an end view of the assembled device, taken from the left side of FIG. 10.

The embodiment variant shown in FIGS. 10 and 11 achieves this object by providing a calibrated interference between the casing 11 and the pin 12.

More particularly, in the example shown, on the inner side walls of the casing 11, in proximity of its front opening 33, a pair of opposing ribs 40 are provided which are specifically housed in corresponding longitudinal grooves 50 formed on the pin 12. This interaction does not constrain the axial sliding of the pin 12 and therefore its insertion in the hole 5 of the side 3 of the furniture item (assembly phase), but hinders the phase of tilting of the pin 12 inside the casing 11, effectively preventing the unhooking of the shelf except as a result of an upward thrust, as indicated by arrow "A" in FIG. 8, which requires a force far greater than the weight "W" of the shelf (FIG. 7), a manoeuvre that is necessary to allow pin 12 to overcome the obstacle offered by ribs 40.

Figure 12:
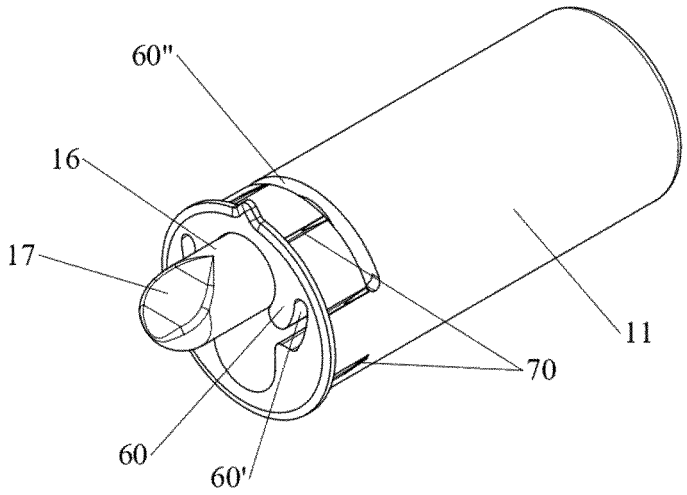
FIG. 12 is an axonometric view of a further alternative embodiment of the device according to the invention.
Figure 12A:
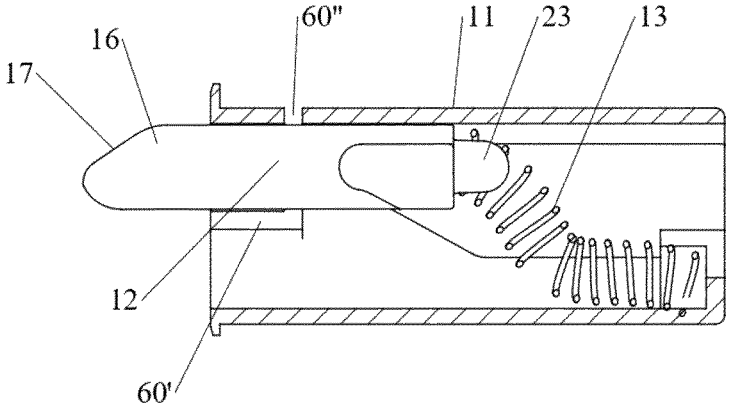
FIG. 12*a* is a median section view of the device of FIG. 1.
Figure 13:
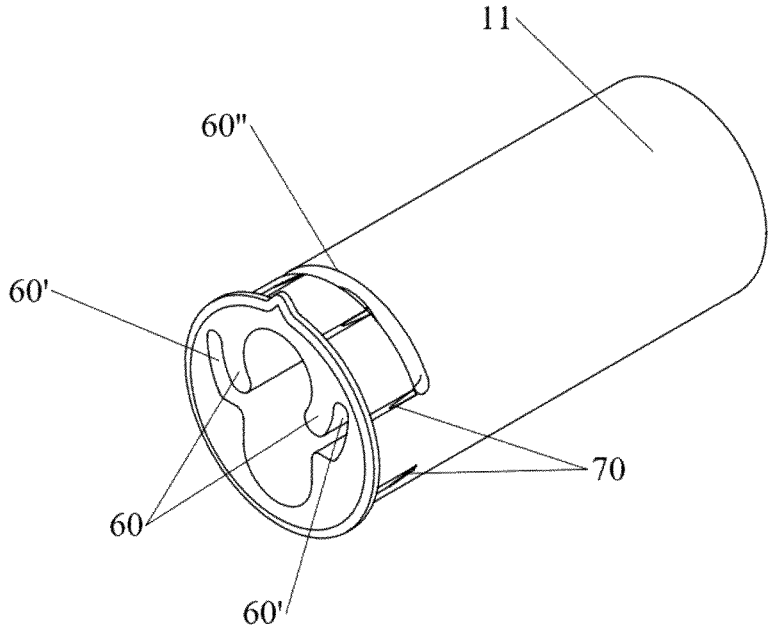
FIG. 13 is an axonometric view of the casing of the device of FIG. 12.
Figure 13A:
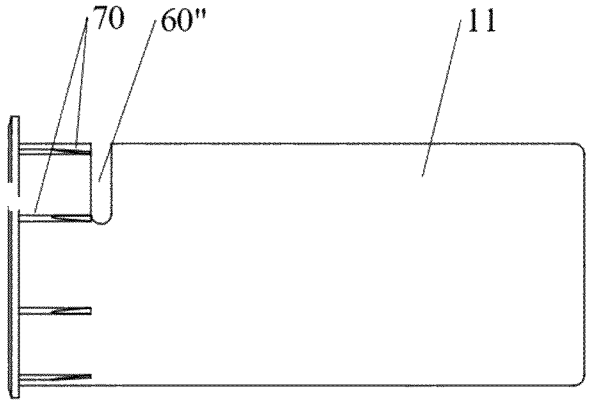
FIG. 13*a* is a side view of the casing of FIG. 13.

FIGS. 12, 13 show a further variant on the solution proposed in FIGS. 10 and 11.

In this case, the engagement of the pin 12 with the casing 11, in order to avoid unintentional disengagement, is obtained by providing, on the inner side walls of the casing 11, in proximity of its frontal opening 33, a pair of opposing ribs 60, free from the rest of the casing 11 by means of appropriate longitudinal slots 60' and circumferential slots 60" partially enveloping the pin 12, but for a good part of its diameter.

The housing that the ribs 60 create for the pin 12 is such that the pin 12 can slide there axially, but its transverse movement of unhooking is prevented, which can only take place if an external force overcomes the elasticity of the ribs 60.

It is possible to calibrate the flexibility of the ribs 60 during the phase of construction of the moulding equipment, lengthening or shortening the length of the slots 60', and therefore distancing the circumferential slot 60" more or less from the front edge of the casing 11, in order to make the ribs 60 more elastic or more rigid, respectively, in such a way as to restrain the pin 12 and consequently the shelf when the furniture item is turned over, respectively more or less.

For the sake of completeness, it should be noted that the grooves indicated with reference numeral 70 in FIGS. 12 and 13 are slight ribs, intended to improve the fixing of the device in the hole formed in the shelf.

These ribs 70 are also present in the embodiments previously described, even if not shown.

From what has been disclosed, the advantages of the invention appear clear, which enables rapid assembly and disassembly of the shelves of furniture items, without the aid of tools and without leaving parts visible.

Although the invention has been described above with particular reference to one of its embodiments given solely by way of non-limiting example, numerous changes and variations will be clear to a person skilled in the art in the light of the description given above. The present invention therefore intends to encompass all modifications and variations that come within the scope of the following claims.

The invention claimed is:

1. A device for supporting and fixing a shelf to a side of a furniture item, the device comprising:

a casing of a substantially cylindrical shape, said casing having an inner cavity, the inner cavity having a front opening;

a pin housed in the inner cavity of said casing; and an elastic member urging against said pin, said elastic member urging against said pin such that a tip of said pin protrudes from an edge of said casing when in one position, wherein the inner cavity has at least an elongated shape extending from the front opening, a cross-section of the elongated shape having a shape that corresponds to a shape of the front opening, the inner cavity having a substantially flat side wall, the inner cavity loosely housing said pin in a plane parallel to the substantially flat side wall, the substantially flat side wall having a longitudinal recess formed therein, said pin having a raised part received in the longitudinal recess of the substantially flat side wall of the inner cavity such that said pin is maintained in the inner cavity in the one position such that the tip protrudes from said casing, said pin being movable inwardly toward the inner cavity of said casing when a force is applied to the tip of said pin so as to cause a tilting action of said pin in the plane parallel to the substantially flat side wall.

2. The device of claim 1, wherein the raised part has a substantially rectangular shape with a rounded ogival end at a front of the raised part.

3. The device of claim 1, wherein said elastic member is positioned between a seat of said casing and a rear of said pin.

4. The device of claim 3, wherein an axis of the seat of said casing is spaced from an axis of said pin.

5. The device of claim 1, wherein said elastic member is a helicoidal spring.

6. The device of claim 5, wherein the helicoidal spring has one end housed in a seat of said casing and an opposite end that receives a cylindrical raised part at a rear of said pin.

7. The device of claim 1, wherein the tip of said pin has a bevelled and tapered end.

8. The device of claim 1, further comprising:

a rib formed on the substantially flat side wall of the inner cavity of said casing, said rib being housed in a corresponding longitudinal groove formed on said pin.

* * * * *